US010309183B2

(12) United States Patent
Cutler

(10) Patent No.: US 10,309,183 B2
(45) Date of Patent: Jun. 4, 2019

(54) INTERNALLY DEGRADABLE PLUGS FOR DOWNHOLE USE

(71) Applicant: Weatherford/Lamb, Inc., Houston, TX (US)

(72) Inventor: I. Marc Cutler, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 873 days.

(21) Appl. No.: 14/535,418

(22) Filed: Nov. 7, 2014

(65) Prior Publication Data

US 2015/0159462 A1 Jun. 11, 2015

Related U.S. Application Data

(60) Provisional application No. 61/901,681, filed on Nov. 8, 2013.

(51) Int. Cl.

| | |
|---|---|
| ***E21B 34/14*** | (2006.01) |
| ***E21B 33/12*** | (2006.01) |
| ***E21B 43/26*** | (2006.01) |

(52) U.S. Cl.

CPC ..... *E21B 33/12* (2013.01); *E21B 34/14* (2013.01); *E21B 43/261* (2013.01)

(58) Field of Classification Search

CPC ..... E21B 33/12; E21B 34/14; E21B 34/063

See application file for complete search history.

(56) References Cited

U.S. PATENT DOCUMENTS

| | | | |
|---|---|---|---|
| 5,607,017 | A | 3/1997 | Owens et al. |
| 7,350,582 | B2 | 4/2008 | McKeachnie et al. |
| 8,127,856 | B1 | 3/2012 | Nish et al. |
| 8,403,037 | B2 | 3/2013 | Agrawal et al. |
| 8,528,633 | B2 | 9/2013 | Agrawal et al. |
| 2005/0205266 | A1 | 9/2005 | Bradley et al. |
| 2007/0107908 | A1 | 5/2007 | Vaidya et al. |
| 2007/0169935 | A1 | 7/2007 | Akbar et al. |
| 2007/0181224 | A1 | 8/2007 | Marya et al. |
| 2008/0135249 | A1 | 6/2008 | Fripp et al. |
| 2009/0211754 | A1 | 8/2009 | Verret et al. |
| 2010/0270031 | A1 | 10/2010 | Patel |
| 2011/0132621 | A1 | 6/2011 | Agrawal et al. |

(Continued)

OTHER PUBLICATIONS

Baker Hughes, "IN-Tallic Disintegrating Frac Balls," obtained from www.bakerhughes.com, (c) 2011 Baker Hughes Incorporated, brochure No. 33833, 2 pages.

(Continued)

*Primary Examiner* — Robert E Fuller

(74) *Attorney, Agent, or Firm* — Blank Rome, LLP

(57) ABSTRACT

Plugs for deployment downhole include a body composed of a first material and include an activating element disposed internally in the body. The activating element has an agent configured to degrade the body. However, the agent is kept from degrading the body until occurrence of an activating trigger. The activating element can include a shell enclosing the agent therein and keeping the agent from reacting with the body's material. The shell can be composed of a breachable material that is breached to allow the agent to react with the first material. To breach the shell, the activating element can further include a breaching element that breaches the shell in response to the activating trigger.

30 Claims, 4 Drawing Sheets

(56) References Cited

U.S. PATENT DOCUMENTS

| | | | | |
|---|---|---|---|---|
| 2011/0186306 | A1 | 8/2011 | Marya et al. | |
| 2012/0175109 | A1* | 7/2012 | Richard | E21B 43/11 166/250.12 |
| 2012/0181032 | A1 | 7/2012 | Naedler et al. | |
| 2012/0234538 | A1 | 9/2012 | Martin et al. | |
| 2012/0273229 | A1 | 11/2012 | Xu et al. | |
| 2013/0062063 | A1 | 3/2013 | Baihly et al. | |

OTHER PUBLICATIONS

World Oil Online, Shale Energy / Fracturing, "Ball-activated sliding-sleeve fracturing best practices," Ali Daneshy, Contributing Editor, Shale, vol. 232 No. 8, obtained from http://www.worldoil.com/August-2011-Ball-activated-sliding-sleeve-fracturing-best-pract downloaded Oct. 28, 2013, 8 pages.

Rapid Design Group Inc., "Frac Balls Testing," Report Prepared for: Bruce Diamond Corporation, Prepared by: Rapid Design Group Inc., Aug. 14, 2012, Nisku, Alberta, 10 pages.

"Frac Balls," Bruce Diamond Corp. 1231 Country St., Attleboro, Massachusetts 02703, obtained from www.brucediamond.com/frac.

Team Oil Tools, "T-Frac System; TEAM Oil Tools—Dissolvable Frac Ball," obtained from TeamOilTools.com/Innovation/TEAM-Patents, (c) 2012, brochure No. 011113, 1 page.

Weatherford, "ZoneSelect Completion System Stimulation Ball," obtained from weatherford.com, (c) 2013, brochure No. 10880.0, 5 pages.

Weatherford, "ZoneSelect Completions System MultiShift Sliding Sleeve (3 1/2- and 5 1/2-in., 4 1/2-in. XLC)," obtained from weatherford.com, (c) 2013, brochure No. 10888.00, 4 pages.

Examination Report in counterpart Australian Application No. 2014346622 dated Jul. 15, 2016, 3 pages.

Office Action in counterpart Canadian Application No. 2929962 dated Feb. 22, 2017, 3 Pages.

PCT International Search Report for corresponding PCT Patent Application No. PCT/US2014/064487; dated Jul. 14, 2015; pp. 1-13.

Swor, L. et al.; "Self-removing frangible bridge and fracture plug"; copyright Sep. 27, 2006; https://www.onepetro.org/conference-paper/SPE-102994-MS; pp. 24-27.

* cited by examiner

INTERNALLY DEGRADABLE PLUGS FOR DOWNHOLE USE

CROSS-REFERENCE TO RELATED APPLICATIONS

This application claims the benefit of U.S. Prov. Appl. 61/901,681, filed Nov. 8, 2013, which is incorporated herein by reference.

BACKGROUND OF THE DISCLOSURE

A number of operations in a wellbore use balls, plugs, or the like to actuate downhole tools, close off fluid flow, and perform other operations. For example, bridge plugs used in plug and perforation operations for completing a wellbore may have balls disposed therein to control fluid flow or may have balls dropped to engage the plugs during fracture operations.

In a staged fracturing operation, multiple zones of a formation may be isolated sequentially for treatment using dropped balls. To achieve this, operators install a fracturing assembly down the wellbore, which typically has a top liner packer, open hole packers isolating the wellbore into zones, various sliding sleeves, and a wellbore isolation valve. When the zones do not need to be closed after opening, operators may use single shot sliding sleeves for the fracturing treatment. These types of sleeves are usually ball-actuated and lock open once actuated. Another type of sleeve is also ball-actuated, but can be shifted closed after opening.

Initially, operators run the fracturing assembly in the wellbore with all of the sliding sleeves closed and with the wellbore isolation valve open. Operators then deploy a setting ball to close the wellbore isolation valve. This seals off the tubing string of the assembly so the packers can be hydraulically set. At this point, operators rig up fracturing surface equipment and pump fluid down the wellbore to open a pressure-actuated toe sleeve so a first zone can be treated.

As the operation continues, operators drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

As background to the present disclosure, FIG. 1A shows an example of a sliding sleeve 10 for a multi-zone fracturing system in partial cross-section during an opened state, and FIG. 1B illustrates a close up view of the sliding sleeve 10. This sliding sleeve 10 is similar to Weatherford's ZoneSelect MultiShift fracturing sliding sleeve and can be placed between isolation packers in a multi-zone completion. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the inner sleeve 30 positions in the housing 20 in a closed state. A breakable retainer 38 initially holds the inner sleeve 30 toward the upper sub 22, and a locking ring or dog 36 on the sleeve 30 fits into an annular slot within the housing 20. Outer seals on the inner sleeve 30 engage the housing 20's inner wall above and below the flow ports 26 to seal them off.

The inner sleeve 30 defines a bore 35 having a seat 40 fixed therein. To open the sliding sleeve 10 in a fracturing operation, operators drop an appropriately sized ball B downhole and pump the ball B until it reaches the seat 40 disposed in the inner sleeve 30.

Once the ball B is seated, built up pressure forces against the inner sleeve 30 in the housing 20, shearing the breakable retainer 38 and freeing the lock ring or dog 36 from the housing's annular slot so the inner sleeve 30 can slide downward. As it slides, the inner sleeve 30 uncovers the flow ports 26 so flow can be diverted to the surrounding formation. The shear values required to open the sliding sleeves 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

After the fracturing job, the well is typically flowed clean, and the ball B is floated to the surface. In some cases, the ball B cannot be floated to the surface because the ball has become wedged in the seat or for some other reason. In any event, the ball seat 40 (and the ball B if remaining) is milled out in a milling operation. The ball seat 40 can be constructed from cast iron to facilitate milling, and the ball B can be composed of aluminum or a non-metallic material, such as a composite. Once milling is complete, the inner sleeve 30 can be closed or opened with a standard "B" shifting tool on the tool profiles 32 and 34 in the inner sleeve 30 so the sliding sleeve 10 can then function like any conventional sliding sleeve that shifts with a "B" tool.

To reduce the need to mill out the balls B, various materials and designs have been used to make the balls disintegrate, dissolve, break apart, or otherwise degrade in the wellbore. Being able to degrade the balls B eliminates the need to flow the balls B back to surface after the fracture operation and reduces the complexity of milling operations for any balls B not floated to the surface. Degradable balls and other plugs find uses in applications other than just sliding sleeves.

A number of materials and designs have been developed to disintegrate, dissolve, break apart, or otherwise degrade balls in a wellbore environment when exposed to certain factors, such as temperatures, pressures, fracture fluids, other pumped fluids, hydrocarbons, time spans, etc. Examples of such materials and designs are disclosed in US 2012/0181032; US 2012/0273229; US 2011/0132621; U.S. Pat. Nos. 8,528,633; 8,403,037; 8,127,856; and U.S. Pat. No. 7,350,582.

The materials and designs condense down to two particular approaches. In the first approach, the structure of the ball is compromised externally when subjected to the wellbore environment. For example, U.S. Pat. No. 8,528,633 discloses a ball having perforations in its outer surface. The perforations control a rate of intrusion of the wellbore environment into the ball and below its outer surface. By controlling this rate of intrusion, the rate of reaction of the ball's material with the environment can be controlled so that the ball is weakened to a point where it can fail due to the stress applied to it.

In another example, US 2011/0132621 discloses a ball having two or more parts that are resistant to dissolution, but are bound together by an adherent material that can dissolve. During use, dissolution of the adherent material allows the two or more parts of the ball to move out of engagement with a ball seat so that the parts pass through the seat.

In the second approach, the material of the ball is compromised externally when subjected to the wellbore environment. For example, US 2012/0273229 discloses a composite downhole article (e.g., ball) having a corrodible core that corrodes at a faster rate in wellbore fluid than the rate that an outer member disposed on the core corrodes. An access point on the outer member can provide access of wellbore fluid to the corrodible core. In another example, US 2012/0181032 discloses a ball composed of a material that disintegrates, dissolves, delaminates, or otherwise experiences a significant degradation of its physical properties over time in the presence of hydrocarbons and formation heat.

As can be seen, both of these approaches subject the ball to the wellbore environment to initiate the degradation externally. Although these approaches may be effective, the need to maintain the structural integrity of the ball during use is a driving consideration for operators. As the industry progresses, higher pressures are being used downhole, and more and more zones are being treated downhole in a given wellbore. To operate properly, a composite ball needs to withstand high fracture pressures and needs to maintain its shape engaging a seat under such pressures. The ball may also need to function properly for longer periods of time. If the ball deforms or fails, then the fluid seal it provides with the seat will be compromised and make the fracture treatment ineffective. In light of this, the tolerances and size differences between deployed balls is becoming smaller and requiring more precision. Existing technology for manufacturing balls is approaching pressure and temperature limitations beyond which the deployed balls become less effective. In addition to fracture balls, other plugs used in other application preferably maintain their integrity while being degradable in a given application.

The subject matter of the present disclosure is directed to overcoming, or at least reducing the effects of, one or more of the problems set forth above.

SUMMARY OF THE PRESENT DISCLOSURE

Embodiments of the present disclosure can be characterized as a plug for deployment downhole. The plug includes a body composed of a first material and includes an activating element disposed internally in the body. The activating element has an agent configured to degrade the body. However, the agent is kept from degrading the body until occurrence of an activating trigger.

In general, the body can be a sphere, a cylinder, a cone, a dart, or other shape, and the first material can be composed of metal, composite, or other polymer, among other materials. The agent can be one or more of an acid, a base, a solvent, a hydrocarbon, a hydrocarbon wax, a salt (ionic compound), an organic compound, or a mixture, among other materials. A single agent can be used. Alternatively, at least two agent components can be kept separate from one another and can be allowed to interact with one another upon occurrence of the activating trigger. In general, the activating trigger can include an impact of the body against a downhole surface; a length of time; a temperature level; a pressure level; a physical deformation; a solid, liquid or gas that expands/contracts at pressure and/or temperature; thermodynamic reaction; or a combination of these.

To degrade the body, the activating agent can be configured to chemically react with the first material of the body. For example, the activating element can include a shell enclosing the agent therein and keeping the agent from chemically reacting with the first material. The shell can be composed of a breachable or breakable material being breached or breaking to allow the agent to react with the first material. To breach or break the shell, the activating element can further include a breaching element that breaches the shell in response to the activating trigger.

The foregoing summary is not intended to summarize each potential embodiment or every aspect of the present disclosure.

DETAILED DESCRIPTION OF THE DISCLOSURE

Figure 1A:
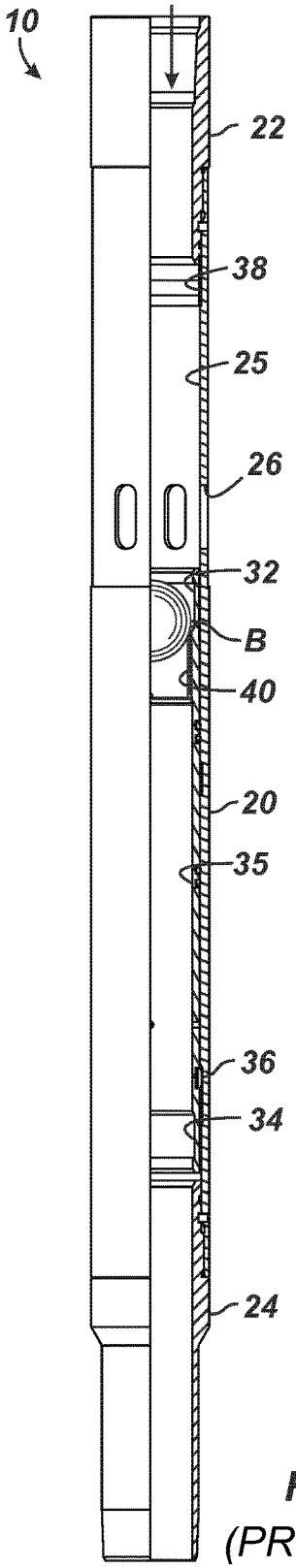
FIG. 1A (PRIOR ART)
FIG. 1A illustrates a sliding sleeve having a ball engaged with a seat to open the sliding sleeve as background to the present disclosure.
Figure 1B:
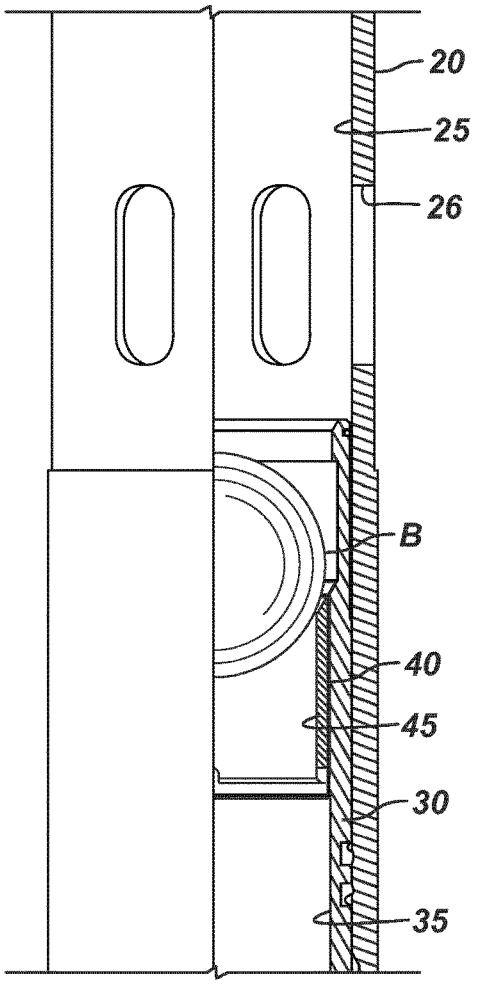
FIG. 1B (PRIOR ART)
FIG. 1B illustrates a close up view of the sliding sleeve in FIG. 1A.
Figure 2A:
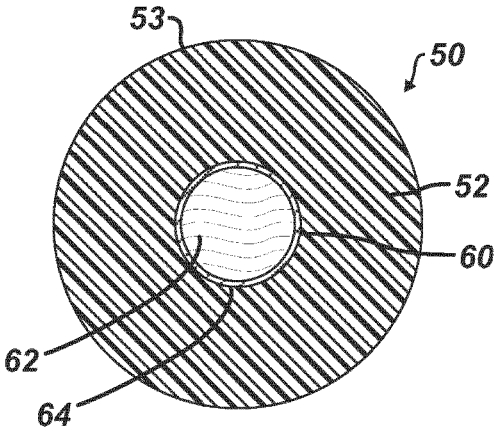
FIG. 2A illustrates a cross-sectional view of a downhole plug according to the present disclosure with a body of the plug formed about an internal activating element.
Figure 2B:
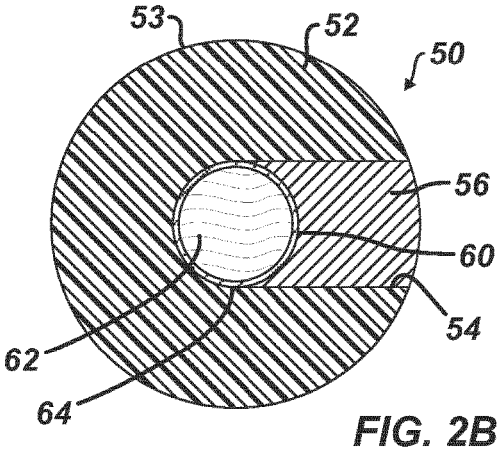
FIG. 2B illustrates a cross-sectional view of another downhole plug according to the present disclosure with an activating element inserted internally into a body of the plug.

FIGS. 2A-2B show cross-sectional views of downhole plugs 50 according to the present disclosure. The plugs 50 can be used in any application were a plug activates or actuates a tool, seals an orifice, engages a seat, etc. For example, the plugs 50 can be used with sliding sleeves, stage tools, composite fracture plugs, or other downhole tools.

In general, the plugs 50 can be a spherical ball as shown so that reference herein may be made to the plug 50 being a ball, such as used to engage a ball seat in a downhole tool. It will be appreciated, however, that the plugs 50 as disclosed herein can have any suitable shape (dart, cylinder, cone, sphere, etc.) for deploying downhole and performing some purpose of sealing, actuating, or the like. Accordingly, reference herein to "plug" 50 connotes any suitable plug, fracture ball, trip ball, opening plug, closing plug, dart, wiper, etc. with any suitable shape for use downhole.

The plugs 50 have a body 52 with an exterior or external surface 53. When deployed downhole, the external surface 53 of the body 52 may be exposed to a wellbore environment and conditions and may engage a seat or the like to form a seal or other type of engagement. Inside its interior, the body 52 includes an activating element 60, such as an ampule, pill, seed, chemical fuse, or the like disposed therein.

In FIG. 2A, the body 52 of the plug 50 completely encompasses the activating element 60 such that the body 52 has been formed, molded, wound, machined, or otherwise manufactured around the element 60. For example, the activating element 60 may be molded in the body 52, which can be composed of a composite material, such as commonly used for fracture balls used with sliding sleeves downhole.

In FIG. 2B, the body 52 has been formed, molded, wound, machined or otherwise manufactured separately. A pocket or hole 54 in the body 52 allows the activating element 60 to be inserted into the body 52, and a filler element 56, material, or the like disposed in the pocket 54 can enclose the activating element 60 in the body 52. In this arrangement, the plug 50 can be manufactured using regular practices and can have the pocket 54 drilled in it. The activating element 60 in the form of an ampule or the like is inserted into the pocket 54. A breaching element (not shown) to break the activating element 60 upon impact with a ball seat, in response to physical (elastic or plastic) deformation of the plug 50, or other trigger can also be inserted in the pocket 54. To complete the plug 50, operators then fill the pocket 53 with material 56, which can be inert, part of the plug's body 52, or part of a chemical fuse.

When the plug 50 of FIG. 2A or 2B is dropped into the well, impact with a ball seat, pressure from a fracture operation, or other activating event or trigger activates or ruptures the activating element 60 inside the plug 50, which causes the element 60 to degrade the plug 50 from inside out.

In general, the body 52 can be composed of any suitable material for downhole use. Accordingly, the body 52 can be composed of a metallic material, including, but not limited to, aluminum, aluminum alloy, zinc alloy, magnesium alloy, steel, brass, aluminum bronze, a metallic nanostructure material, cast iron, etc. Additionally, the plug 50 can be composed of any suitable non-metallic material, including, but not limited to, ceramics, plastics, composite materials, phenolics (e.g., G-10), polyamide-imide (e.g., Torlon®), polyether ether ketone (PEEK), polyglycolic acid (PGA), thermosets, thermoplastics, or the like. (TORLON is a registered trademark of Solvay Specialty Polymers, LLC of Alopharetta, Ga.)

The activating element 60 is composed of or contains an activating agent 62, which can be a solid, liquid, gas, gel, or the like, designed to react with the material of the body 52. The reaction of the activating element 60 with the body 52 can dissolve, degrade, erode, eat away, break apart, melt, or otherwise compromise the structural integrity of the body 52 through a chemical or other reaction. As disclosed herein, the reaction between the body's material and the element's agent 62 can dissolve, erode, corrode, disintegrate, break apart, or otherwise degrade the body 52. In that light, a number of reactions between materials can be used to achieve the purposes of the present disclosure. In general, the activating agent 62 may be composed of one or more of an acid, a base, a solvent, a hydrocarbon, a hydrocarbon wax, a salt (ionic compound), an organic compound, a mixture, or the like.

As shown here, the activating element 60 has the form of an ampule having an outer shell 64 holding the internal agent 62. Thus, depending on the composition of the agent 62 and how it reacts with the body's material, the activating element 60 may have some form of preventive interface or shell 64 to initially prevent reaction between the materials of the body 52 and agent 62. For example, the shell 64 can be composed of glass, plastic, wax, an ionic salt, calcium carbonate, ceramic, or other material.

The activating element 60 may begin reacting with the body's material when one or more particular activating triggers occur. In general, the activating trigger may be an impact of the plug 50 while deployed downhole; an amount of deformation of the plug 50 from applied pressure; a heat level experienced downhole; an internal pressure level experienced downhole; a length of time; a solid, liquid, or gas that expands/contracts at pressure and/or temperature; a thermodynamic reaction, or a combination of these.

As one example, the agent 62 of the activating element 60 can be an acid of sufficient quantity and strength to chemically react with the material of the body 52, which can be composed of metal. When the shell 64 of glass or other material is broken or breached by impact or other trigger, the acid of the activating agent 62 can then react in an acid-metal reaction with the metal of the body 52 to form a metal salt and hydrogen.

Alternatively, the activating element 60 can be composed of one or more agents 62 that experience a reaction when exposed to the heat or pressure in the wellbore. When the activating agent 62 reacts to such a trigger, the agent 62 begins to degrade, rupture, break, erode, etc. the body of the plug 50. For example, the activating agent 62 may be composed of a material that expands rapidly when subjected to the heat in the wellbore environment. Many types of materials expand when heated so any of a number of materials can be used. Eventually, the internal pressure of the reaction can break apart the plug 50.

Alternatively, the activating element 60 can be composed of two or more agents 62 that experience a reaction when exposed to one another. When the agents 62 of the activating element 60 reacts with one another, the reaction or its product begins to degrade, rupture, break, erode, etc. the body of the plug 50. For example, the activating element 60 may be composed of agents 62 that undergo a rapid exothermal reaction when exposed to one another and can eventually break apart the plug 50. Some examples of materials that can react with one another to degrade the plug include peroxide and sulfuric acid, water and strong acid, water and an anhydrous salt, water and calcium chloride, and water and calcium carbide.

As one example, the body 52 can be composed of a suitable material for use in a wellbore environment that may not be specifically expected to dissolve, disintegrate, break apart, or otherwise degrade under operating conditions. As such, the body 52 can be composed of several types of metal, composite, or polymer materials currently used in oilfield applications. These materials may typically be incompatible with certain chemical agents (e.g., hydrocarbons, solvents, acids, etc.) that dissolve, weaken, or degrade the material. Accordingly, the activating agent 62 of the element 60, however, may contain a hydrocarbon, solvent, acid, etc. to degrade the body's material 52. To prevent or hinder interaction of the activating agent 62 with the body's material 52, the element's shell 64 may be composed of a breachable or breakable material (e.g., glass) suited for containing the acid agent 62. The shell 64 can be composed of other materials (plastic, membrane, glass, etc.) depending on the internal agent 62 to be contained.

As can be seen from the above discussion, carrying the agent 62 in the plug 50 can eliminate problems found in the prior art that require accurately spotting or pumping a suitable chemical agent to a plug after fracing so as to degrade the plug externally. Moreover, most dissolvable plugs in the prior art must be weakened externally on the exterior to subsequently allow them to degrade. Therefore, carrying the agent 62 internal to the plug 50 as disclosed herein allows the plug 50 to have a stronger exterior, but still degrade after use from the inside-out.

Figure 3A:
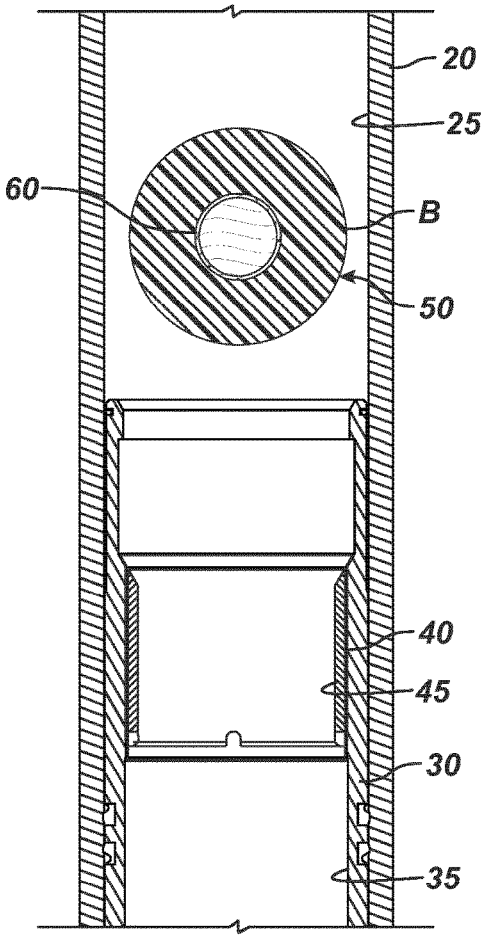
FIGS. 3A-3B illustrates a sliding sleeve having a plug according to the present disclosure engaged with a seat to open the sliding sleeve.
Figure 3B:
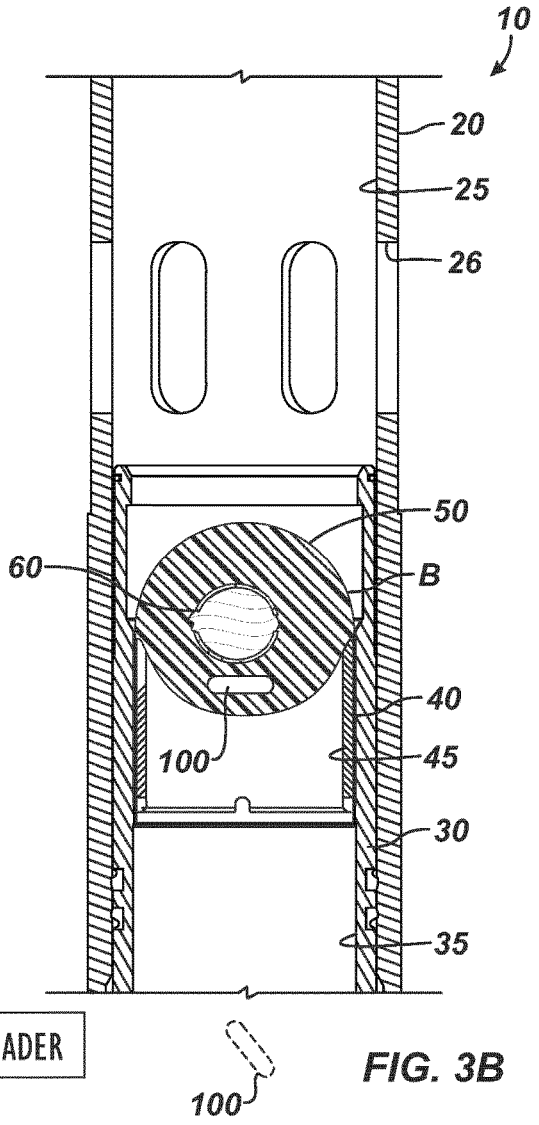

Continuing with discussion of how the plug 50 is used, FIGS. 3A-3B shows the plug 50 of FIG. 2A being deployed to a seat 40 on a sliding sleeve 10 as commonly used downhole during fracture operations. As previously noted, the sliding sleeve 10 includes a housing 20 defining a bore 25 with an inner sleeve or insert 30 movable therein to open or close fluid flow through the housing's flow ports 26 based on the inner sleeve 30's position. The inner sleeve 30 defines a bore 35 having a seat 40 fixed therein.

The plug 50, which is appropriately sized, is deployed downhole and lands on the seat 40. With the plug 50 seated, built-up pressure forces against the inner sleeve 30 in the housing 20, shearing a breakable retainer (not shown) and freeing the inner sleeve 30 to slide downward. As it slides, the inner sleeve 30 uncovers the flow ports 26 so flow can be diverted to the surrounding formation. The shear values required to open the sliding sleeve 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated plug 50 prevents fluid and proppant from communicating further down the tubing string. The pressures used in the fracturing operation can reach as high as 15,000-psi.

With the plug 50 deployed downhole, a number of triggers can be used to activate the activating agent to degrade the plug 50. For example, as the plug 50 is deployed down the tubing string, the plug 50 impacts the seat 40 in the sliding sleeve 10. Typically, the plug 50 also impacts a number of seats uphole of the designated seat 40. An expected impact level of a plug 50, such as a dropped ball, with a seat can be from about 1100-lbf to 22,000-lbf in some implementations. Accordingly, one or more of the impacts of the deployed plug 50 with seats can trigger the activating element 60 to begin degrading the plug's body 52, for example, by compromising the shell 64 holding the activating agent 62.

In another form of trigger, the plug 50 engaged in the seat 40 can be deformed by the high pressure applied against during the fracture operation. For example, the plug 50 in the form of a composite ball may be expected to deform by the impact of the plug 50 hitting a seat and/or the pumping of fracturing fluid against the seated plug 50. These can provide the necessary force(s) to deform the plug 50 by tending to compress, squeeze, flatten, elongate, or otherwise alter the shape of the plug 50. Additionally, variations in pressuring up and down can allow the plug 50 to seat and then float alternatingly, which may also repeatedly deform and ultimately alter the shape of the plug 50. The deformation of the plug 50 during the fracture operation can then trigger the activating element 60 to begin degrading the plug's body 52, for example, by breaching, cracking, breaking, or otherwise compromising the shell 64 containing the internal agent 62.

In another form of trigger, the plug 50 engaged in the seat 40 can be subjected to high temperatures during the fracture operation. Over time, the temperature can trigger the activating element 60 to begin degrading the plug's body 52, for example, by compromising the shell 64 containing the internal agent 62. As disclosed herein, these and other triggers can be used alone or in combination with one another to activating the element 60 to degrade the plug 50.

Once triggered, reaction between the internal agent 62 and the body's material commences and begins to degrade the plug 50 from the inside-out. All the while, the plug 50 at least externally maintains its integrity, allowing the plug 50 to achieve its purposes of sealing, engagement, and the like at least until the body 52 is internally degraded to a point where it is structurally compromised. The compromised body 52 can dissolve, erode, break into pieces, collapse, implode, etc.

After the fracturing job, the well is typically flowed clean, and any remaining material of the plug's body 52 can be floated to the surface. In cases where the remaining material cannot be floated, the body's material can be readily milled out in a milling operation. Because the plug's body 52 is no longer uniform or whole, the milling operation can better mill up any the remnants of the body 52 regardless of its material composition.

As shown in FIG. 3B, a given plug 50 can include an RFID tag or other sensor element 100. As the plug 50 degrades, the sensor element 100 is free to pass through any seat 40, landing, or the like. Downhole of the various tools, the tubing string can include a detector 110 (e.g., RFID reader) to detect passage of the freed sensing element 100. Using the detector 110, operators can determine that the given plug 50 has degraded, which can be used as a confirmation that the tool, sliding sleeve 20, tubing string, or the like is cleared.

Figure 4A:
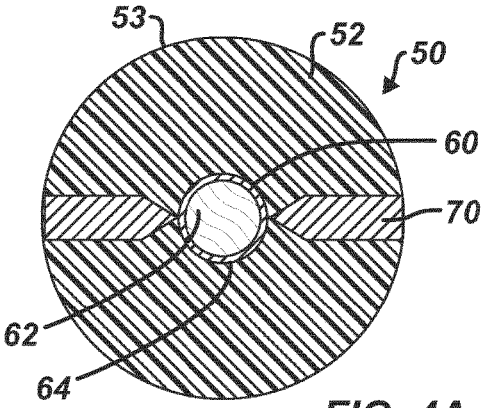
FIGS. 4A-4B illustrate configurations of the disclosed plug having breaching elements disposed relative to the internal activating element.
Figure 4B:
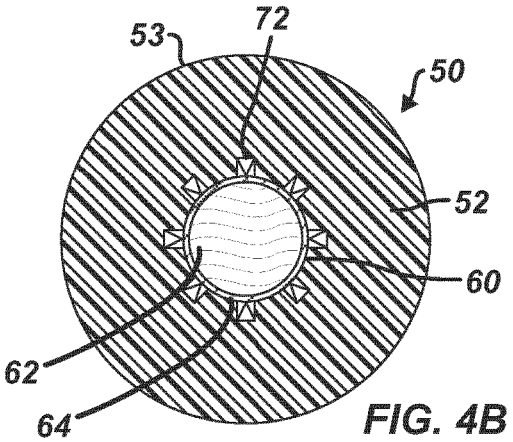

FIGS. 4A-4B show alternative configurations of plugs 50 having an activating element 60 disposed therein. As shown in FIG. 4A, breaching elements 70, in the form of pins, spikes, or the like, can be disposed in the plug's body 52 and can extend roughly from the plug's exterior surface 53 to the activating element 60. These breaching elements 70 can be composed of the same or different material than the plug's body 52, and they may be inserted in machined holes or channels. When the plug 50 is subjected to pressures, the breaching elements 70 may move, adjust, or the like so that the elements 70 breach the activating element's shell 64 and initiate the desired degradation of the plug's body 52.

FIG. 4B shows another arrangement in which breaching elements 72 are disposed adjacent the activating element 60 and are enclosed primarily inside the plug's body 52. All the same, these breaching elements 72 can function in a similar manner to those described above.

Figure 5A:
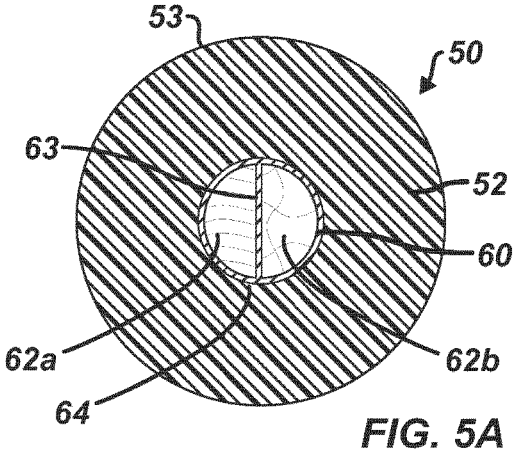
FIGS. 5A-5B illustrate configurations of the disclosed plug having internal activating elements with multiple agents.
Figure 5B:
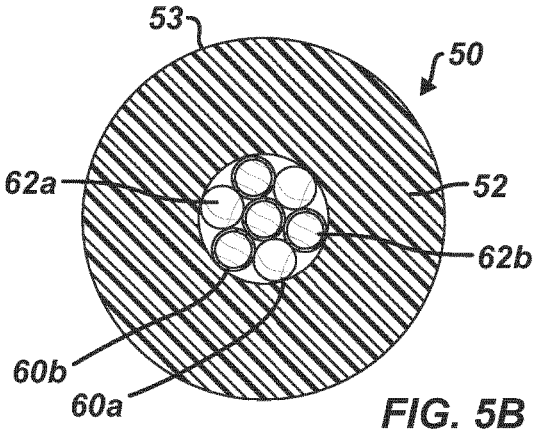

FIGS. 5A-5B show additional configurations of plugs 50 having an activating element 60 disposed therein. As shown in FIG. 5A, the activating element 60 includes at least two separate agents 62*a-b* that are initially kept separate from one other. When the agents 62*a-b* combine, they may initiate the reaction with the plug's body 52 to achieve the intended degradation. The activating element 60 may have a breachable container or shell 64 having chambers with a division 63 for the agents 62*a-b*. When the plug's body 52 is deformed, the shell 64 or the division 63 may break, rupture, etc. so that the agents 62*a-b* combine to produce the desired reaction. Alternatively, one of the agents 62*a* may act to degrade the shell 64 so that the other agent 62*b* can interact with the plug's body 52. In this sense, the shell 64 may not be intended to physically break, as the interaction of the agent 62*a* is intended to breach the shell 64 after a trigger (pressure, heat, impact, etc.) and allow the reaction to follow.

FIG. 5B shows an example where activating elements 60*a-b* includes separate agents 62*a-b* disposed in separate ampules, shells, pills, or the like. These two agents 62*a-b* can operate in much the same way as discussed above. Therefore, one agent 62*a* may act to degrade the shell 60*b* of the other agent 62*b* so the other agent 62*b* can interact with the plug's body 52. Alternatively, the two agents 62*a-b* may combine together when triggered to react with the plug's body 52. Breaching elements (not shown) may also be provided.

Figure 6:
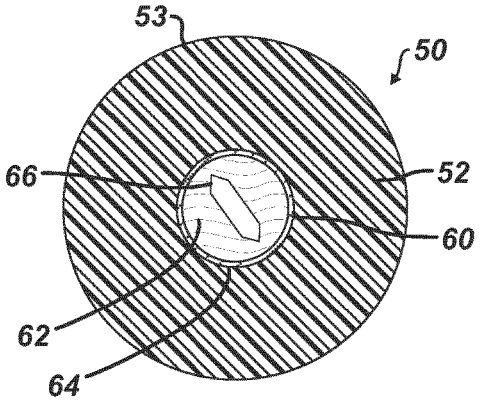
FIGS. 6-7 illustrate cross-sectional views of additional downhole plugs with activating elements according to the present disclosure.

FIG. 6 illustrates a cross-sectional view of another downhole plug 50 according to the present disclosure having an activating element 60 with an internal breaching element 66. As before, the activating element 60 can include a shell 64 containing an activating agent 62. The breaching element 66 in this arrangement is contained in the shell 64. Impact of the plug 50, deformation of the plug 50, or other physical trigger may cause the breaching element 66 to breach the shell 64 and allow the activating agent 62 to interact with the material of the plug's body 52.

Figure 7:
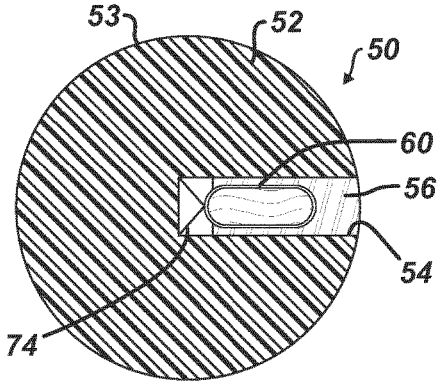

FIG. 7 illustrates a cross-sectional view of yet another downhole plug 50 according to the present disclosure with an activating element 60 inserted in a formed pocket or hole 54. As discussed previously, the pocket or hole 54 in the body 52 allows the activating element 60 to insert into the body 52, and a filler element 56, material, or the like disposed in the pocket 54 can enclose the element 60 in the body 52. As shown here, a breaching element 74 may be inserted into the pocket 54 along with the activating element 60 so the breaching element 74 can break the activating element 60 (upon impact with a ball seat, in response to pressure deformation of the plug 50, or other activation).

Figure 8:
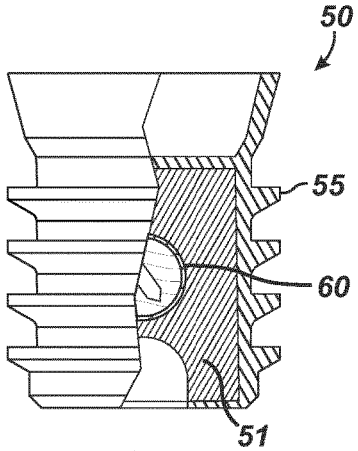
FIGS. 8-10 illustrate partial cross-sectional views of different configurations of downhole plugs according to the present disclosure.
Figure 9:
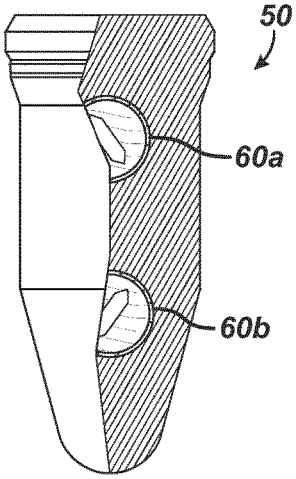
Figure 10:
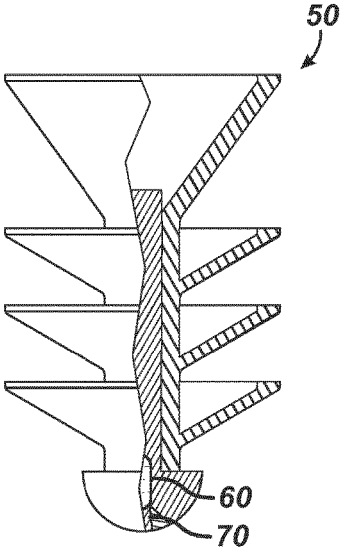

As discussed above, the disclosed plugs 50 can be balls, although plugs can be used. For example, FIGS. 8-10 illustrate partial cross-sectional views of different configurations of downhole plugs 50 according to the present disclosure. In FIG. 8, the downhole plug 50 has the form of a closing or wiper plug, which can be composed of a combination of materials and can be used for closing a stage tool or the like downhole. In FIG. 9, the downhole plug 50 has the form of a cone, which can be composed of metal (e.g., aluminum) and can be used for opening a stage tool or the like downhole. In FIG. 10, the downhole plug 50 has the form of a dart, which can be composed of a combination of materials and can be used in cementing and other operations.

Because such plugs 50 may have more material or denser material than a fracture or trip ball, more than one activating agent or a larger activating agent may be used inside the plug 50. For example, the cone 50 in FIG. 9 has more than one activating element 60*a-b*. Also, the denser components of the plug 50, such as the core 51 of the closing plug 50 in FIG. 8 may have an activating element 60, while the sealing skin 55 is not expected to degrade or is degraded separately or concurrently with the activating element 60.

Finally, because these plugs 50 may be less prone to deformation, the activating agent 60 may include embodiments disclosed herein that react to impact, heat, breaching elements, or other such trigger rather than a deformation to start the degradation process.

As can be seen, the activating elements 60 degrade the plugs 50 from the inside-out. This is in contrast to how plugs are typically degraded externally from the outside-in due to exposure to the conditions in the wellbore or due to intrusion of the wellbore fluid into the plug.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A plug for downhole deployment, comprising:

an outer body of the plug composed of a first material and having an interior and an exterior; and at least one shell disposed in the interior of the outer body and composed of a second material, the at least one shell defining a hollow containing at least one activating agent, the second material of the at least one shell being breachable; and at least one breaching body disposed in the outer body and composed of a solid material, the at least one breaching body being in breaching contact with the at least one shell, the at least one activating agent releasable from the at least one breached shell, the first material of the outer body being degradable by the at least one released activating agent acting from the interior of the outer body toward the exterior of the outer body.

2. The plug of claim 1, wherein the outer body is selected from the group consisting of a ball, a fracture ball, a trip ball, an opening plug, a closing plug, a dart, a cone, a cylinder, and a wiper.

3. The plug of claim 1, wherein the first material is selected from the group consisting of metallic material, aluminum, aluminum alloy, zinc alloy, magnesium alloy, steel, brass, aluminum bronze, metallic nanostructure material, cast iron, non-metallic material, ceramic, plastic, composite material, phenolic, polyamide-imide, polyether ether ketone, polyglycolic acid, thermoset, and thermoplastic.

4. The plug of claim 1, wherein the second material is selected from the group consisting of glass, wax, an ionic salt, calcium carbonate, metallic material, non-metallic material, ceramic, plastic, composite material, phenolic, polyamide-imide, polyether ether ketone, polyglycolic acid, thermoset, and thermoplastic.

5. The plug of claim 1, wherein the at least one activating agent is selected from the group consisting of an acid, a base, a solvent, a hydrocarbon, a hydrocarbon wax, a salt (ionic compound), an organic compound, a heat reactive material, an exothermal reacting compound, peroxide and sulfuric acid, water and strong acid, water and an anhydrous salt, water and calcium chloride, and water and calcium carbide.

6. The plug of claim 1, further comprising a sensor element disposed in the interior of the outer body and escapable from the degraded first material.

7. The plug of claim 1, wherein the at least one breaching body is disposed in the interior of the outer body in breaching contact with the at least one shell.

8. The plug of claim 7, wherein the at least one breaching body disposed in the interior of the outer body is disposed exterior to the at least one shell.

9. The plug of claim 8, wherein a portion of the at least one breaching body is disposed at the exterior of the outer body.

10. The plug of claim 7, wherein the at least one breaching body is disposed in the hollow of the at least one shell in breaching contact with the at least one shell.

11. The plug of claim 1, wherein the at least one shell comprises a first shell and a second shell, and wherein the at least one activating agent comprises a first agent in the first shell and a second agent in the second shell.

12. The plug of claim 11, wherein the first and second agents interact in contact with one another.

13. The plug of claim 11, wherein the first agent breaches the second shell, and wherein the second agent interacts with the first material of the outer body.

14. The plug of claim 1, wherein the outer body defines a pocket from the exterior to the interior in which the at least one shell is disposed, and wherein the outer body comprises a filler disposed in the pocket at the exterior and enclosing the at least one shell in the interior.

15. The plug of claim 1, wherein the at least one shell is breachable in response to one or more of a trigger, an impact, a temperature, a pressure, a deformation, a time interval, a chemical reaction, an exothermic reaction, an expansion, and a contraction.

16. The plug of claim 1, wherein the solid material comprises a different material than the first material.

17. The plug of claim 1, wherein the at least one breaching body defines a hollow containing the at least one activating agent.

18. A downhole method, comprising:

deploying a plug downhole, the plug comprising an outer body, at least one shell, and at least one breaching body, the outer body composed of a first material and having an interior and an exterior, the at least one shell disposed in the interior of the outer body and composed of a second material, the at least one shell defining at least one hollow containing at least one activating agent, the at least one breaching body disposed in the outer body and composed of a solid material, the at least one breaching body being in breaching contact with the at least one shell;

exposing the plug to a trigger;

releasing the at least one activating agent in the interior of the plug in response to the exposure by breaching the at least one shell in the interior of the plug with the at least one breaching body; and degrading the outer body from the interior of the outer body toward the exterior of the outer body with the at least one released activating agent.

19. The method of claims 18, wherein exposing the plug to the trigger comprises exposing the plug to one or more of an impact, a temperature, a pressure, a deformation, a time interval, a chemical reaction, an exothermic reaction, an expansion, and a contraction.

20. The method of claim 18, wherein breaching the at least one shell in the interior of the plug comprises breaking, cracking, dissolving, rupturing, melting, eroding, eating away, or compromising integrity of the at least one shell.

21. The method of claim 18, wherein the at least one breaching body is disposed in the interior of the outer body.

22. The method of claim 21, wherein the at least one breaching body is disposed in the at least one hollow of the at least one shell.

23. The method of claim 21, wherein releasing the at least one activating agent from the at least one breached shell further comprises releasing a first of the at least one activating agent from a first of the at least one shell and releasing a second of the at least one activating agent from a second of the at least one shell.

24. The method of claim 23, wherein degrading the outer body from the interior of the outer body toward the exterior of the outer body with the at least one released activating agent comprises interacting the first and second agents in contact with one another.

25. The method of claim 23, wherein releasing the at least one activating agent from the at least one breached shell comprises breaching the second shell with the first agent and interacting the second agent with the outer body.

26. The method of claim 18, wherein degrading the outer body from the interior of the outer body toward the exterior of the outer body with the at least one released activating agent comprises dissolving, eroding, eating away, cracking, breaking into pieces, collapsing, imploding, or melting material of the outer body.

27. A plug for downhole deployment, comprising:

a body of the plug composed of a first material and having an interior and an exterior;

a shell comprising a first chamber and a second chamber disposed in the interior and composed of a second material, the second material of the at least one shell being breachable;

at least one activating agent comprising a first agent disposed in the first chamber and a second agent disposed in the second chamber, a division dividing the first chamber from the second chamber and breaching between the first chamber and the second chamber to place the first agent in contact with the second agent, the first material of the body being degradable by the at least one activating agent acting from the interior of the body toward the exterior of the body.

28. A plug for downhole deployment, comprising:

a body of the plug composed of a first material and having an interior and an exterior;

at least one shell comprising a first shell and a second shell disposed in the interior, at least the second shell being composed of a second material being breachable;

at least one activating agent comprising a first agent disposed in the first shell and a second agent disposed in the second shell, the second agent breaches the first shell, the first material of the body being degradable by the at least one activating agent acting from the interior of the body toward the exterior of the body.

29. The plug of claim 28, wherein the first agent in the first shell interacts with the first material of the body.

30. The plug of claim 28, wherein the second agent interacts in contact with the first agent in the first shell.

* * * * *